United States Patent [19]

Metzger

[11] 4,082,516

[45] Apr. 4, 1978

[54] MODIFIED STARCH CONTAINING LIQUID FUEL SLURRY

[75] Inventor: Grant W. Metzger, San Andreas, Calif.

[73] Assignee: Carbonoyl Company, San Francisco, Calif.

[21] Appl. No.: 745,160

[22] Filed: Nov. 26, 1976

Related U.S. Application Data

[63] Continuation-in-part of Ser. No. 594,393, Jul. 9, 1975, which is a continuation-in-part of Ser. No. 446,302, Feb. 27, 1974, Pat. No. 3,907,134.

[51] Int. Cl.[2] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,390,232 | 9/1921 | Bates | 44/51 |
| 1,431,225 | 10/1922 | Greenstreet | 44/51 |
| 2,118,477 | 5/1938 | Roberts | 44/51 X |
| 2,668,757 | 2/1954 | Hansley | 44/51 |
| 3,661,815 | 5/1972 | Smith | 260/17.4 |
| 3,764,547 | 10/1973 | Schlinger et al. | 44/51 X |
| 3,907,134 | 9/1975 | Metzger | 44/51 |
| 4,002,435 | 1/1977 | Wenzel et al. | 44/51 |

*Primary Examiner*—Patrick P. Garvin
*Assistant Examiner*—William G. Wright
*Attorney, Agent, or Firm*—Townsend and Townsend

[57] ABSTRACT

A substantially water free, high solids content, stably dispersed combustible fuel slurry is provided, with a method of preparing the slurry. The slurry contains a minor amount of a solid particulate carbonaceous material such as powdered coal, with substantially the entire balance of the slurry being comprised of a liquid hydrocarbon fuel, particularly a heavy fuel oil. In extremely minor amounts are anionic surfactants, particularly soaps, and a stabilizing amount of a starch modified with an anionic polymer.

10 Claims, No Drawings

MODIFIED STARCH CONTAINING LIQUID FUEL SLURRY

CROSS-REFERENCE TO RELATED APPLICATIONS

This application is a continuation-in-part of application Ser. No. 594,393, filed July 9, 1975 which in turn is a continuation-in-part of application Ser. No. 446,302 filed Feb. 27, 1974, now U.S. Pat. No. 3,907,134.

BACKGROUND OF THE INVENTION

1. Field of the Invention

With the increasing scarcity of liquid fuels, such as oil, there have been increased efforts to find substitute sources of thermal energy. One of the promising sources is to use a combination of small particulate coal dispersed in heavy oils. However, such dispersions inherently have a number of problems. The coal is partially soluble in the oil, so that the coal particles swell and can cause gellation of the slurry. Secondly, materials extracted from the coal by the oil can greatly enhance the viscosity of the slurry, so as to make the slurry only difficulty flowable. Finally, it is necessary to provide a stable dispersion or a dispersion which can be reconstituted with mild agitation. It has been found that coal has a tendency to settle with time in oil-coal slurries.

2. Description of the Prior Art

See U.S. Pat. No. 3,661,815 for a description of a modified starch and U.S. Pat. No. 3,907,134, and the patents cited therein for a description of coal-fuel slurries.

SUMMARY OF THE INVENTION

Stable particulate carbonaceous fuel dispersion in heavy fuel oils can be achieved by employing in combination at least one anionic surfactant and a polymer modified starch, when the polymer has a number of anionic sites.

DESCRIPTION OF THE SPECIFIC EMBODIMENTS

Stable combustible fuel slurries are provided comprised of a minor but significant amount of a solid particulate carbonaceous material and a liquid hydrocarbon fuel, normally a heavy fuel oil, with a dispersant composition employing a combination of at least one anionic surfactant and a polymer modified starch, wherein the polymer has a significant number of anionic sites.

For the purposes of this invention, "solid particulate carbonaceous material" shall include such materials as bituminous, sub-bituminous and anthracite coals, coke, petroleum coke, lignite, charcoal, peat, etc., and combinations thereof. The expression "liquid hydrocarbon fuel" intends crude and refined hydrocarbon based oils, including without limitation by enumeration petroleum fuel oils, heavy residual oils, crude oils, and the like. More particularly the oils of interest will have a viscosity in the range of about 50 to 300 seconds Saybolt Universal at 175° F. Bunker C(No. 6) residual fuel oil is particularly useful.

The particulate carbonaceous material will normally be crushed and/or pulverized so that at least about 80 weight percent of the carbonaceous material will pass through a 200 U.S. mesh sieve. A significant but minor amount of particles may be present which do not pass through a 100 U.S. mesh sieve. While smaller particles may be employed, the cost of the additional grinding is usually not warranted by any additional advantages obtained in the dispersion.

The weight percent of the carbonaceous material will generally range from about 5 to 50 weight percent, preferably from about 20 to about 40 weight percent. Except for the addition of the dispersant additives, the fuel oil will comprise the balance of the slurry. Therefore, of the coal-fuel oil combination, the fuel oil will generally be present in from about 50 to 95 weight percent, more usually from about 60 to 80 weight percent.

To the carbonaceous material-oil slurry will be added a small amount of an anionic surfactant, which includes detergents (sulfonates and sulfates) and fatty acids of from about 10 to 18 carbon atoms, more usually from about 12 to 16 carbon atoms. The surfactant will be present in from about 0.05 to 0.5, more usually from about 0.05 to 0.25 weight percent of the slurry. Normally the surfactant will be added as a aqueous solution, with the surfactant being present in from about 1 to 30 weight percent, more usually from about 2 to 20 weight percent, and preferably from about 2 to 15 weight percent. The addition of the surfactant to the carbonaceous material-oil composition will normally provide water in from about 0.5 to 5 weight percent, more usually from about 1 to 3 weight percent based on the total composition.

The next additive is the modified starch. The starch is modified with a polar polymer which has a significant number of anionic sites. An illustrative polymer modified starch may be found in U.S. Pat. No. 3,661,815. Specifically, a polymer, such as an acrylate and methacrylate, either as esters of alchols of from 1 to 2 carbon atoms or nitriles e.g. acrylonitrile and methacrylonitrile, is grafted onto starch, where the weight ratio of the monomer (substantally equivalent to polymer) to the starch is in the range of about 0.3 to 3, more usually about 0.75 to 2 and preferably about 0.75 to about 1.5. After preparation of the graft polymer, the polymer is then partially hydrolyzed in accordance with known procedures to provide a product having a significant number of carboxylic acid groups. Usually, at least 25% of the acid groups will be hydrolyzed and not more than about 90%, more usually at least about 40% and not more than about 75% of the acid groups will be hydrolyzed. Usually, the product will be employed as the acid or alkali metal salt e.g. sodium, or mixtures thereof.

The description of the modification of the starch and subsequent hydrolysis set forth in U.S. Pat. No. 3,661,815 is incorporated herein by reference.

The modified starch will generally be added at about 0.003 to 0.025 weight percent of the coal-oil mixture, more usually from 0.005 to 0.015 of the coal-oil mixture. Conveniently, the modified starch may be added as an aqueous solution at concentrations of from about 0.005 to about 0.1 weight percent, preferably at saturation. The amount of water employed is not critical, but should provide a convenient means for adding the modified starch to the dispersion.

The total amount of water included in the slurry will generally range from about 1 to 5 weight percent, usually from about 1 to 4 weight percent, and more usually from about 2 to 4 weight percent.

The grafted starch and anionic surfactant can be supplied as a dry mixture or solution, having from about 0.1 to 2 weight percent solids. The weight ratio of the grafted starch to the anionic surfactant will normally be about 5-20:1.

In preparing the slurry, pulverized carbonaceous material e.g. coal is provided and is added to the liquid fuel at an elevated temperature, normally above about 50° C, preferably above about 70° C, and usually at about 100° C. The minimum amount of heat required to provide a readily flowable product will normally be employed. The dispersing reagents are then added and the total mixture thoroughly agitated. The slurry is then ready for use as a fuel. It is found that slurries prepared according to this invention are stable for long periods of time without settling tendencies. In order to demonstrate the subject invention, the following composition was prepared.

TABLE I

| | wt % |
|---|---|
| #6 Oil | 64.1 |
| Coal (Pittsburg seam) | 32.1 |
| Soap[1] | 0.13 |
| Grafted starch[2] | 0.0085 |
| Water | 3.66 |

[1]sodium stearate supplied commercially
[2]Polymer 35-A-100, supplied by Grain Processing Corp.

Coal was pulverized to 80 weight percent passing 200 mesh. The oil was heated to 85° C and the pulverized coal, saturated soap solution and saturated polystarch solution were added to the heated oil and thoroughly mixed.

The viscosity of the slurry was about 120 seconds Saybolt Universal and the slurry could be readily pumped and atomized for combustion. The slurry was kept at about 85° C for over 100 hours without any evidence of gelation. After 48 hours, the solution had a coal particle gradient, the coal concentrating in the lower portion of the slurry. However, there was no evidence of the coal settling out and upon mild agitation, a homogeneous slurry was reformed.

A number of additional experiments were carried out as described above, substituting one or more of the ingredients with different ingredients.

When a sub-bituminous coal of high ash content was employed instead of the coal of composition 1, the results were substantially the same except that the viscosity was found to be about 135 seconds Saybolt Universal.

By substituting the fuel oil in composition No. 1 with a No. 5 fuel oil, a gradient was more rapidly established, but there still was no settling out and the homogeneous slurry could be obtained with mild agitation.

By comparison, where other hydroxylic materials were substituted for the modified starch, such as methyl cellulose and carboxymethyl cellulose, rapid settling of the coal particles was observed and reformation of the homogeneous slurry was only difficulty achieved.

The subject method provides a novel and inexpensive way for providing coal-fuel oil slurries having high coal contents. By using extremely small amounts of a dispersing agent composition, stable coal-fuel oil slurries may be obtained, where the coal remains stably dispersed in the fuel for long periods of time without gelation.

Although the foregoing invention has been described in some detail by way of illustration and example for purposes of clarity of understanding, it will be obvious that certain changes and modifications may be practiced within the scope of the appended claims.

What is claimed is:

1. A substantially water free, high solids content, stable and combustible fuel slurry comprising a mixture of a solid particulate carbonaceous material in from about 5 to 50 weight percent and a liquid hydrocarbon fuel having a viscosity in the range of about 50 to 300 SSU at 175° F in from about 95 to 50 weight percent, up to 5 weight percent of water based on said mixture, from about 0.05 to 0.5 weight percent based on said mixture of an anionic surfactant, and from about 0.003 to about 0.025 weight percent of said mixture of an anionic polymer grafted starch, wherein the weight ratio of the polymer to said starch is in the range of about 0.3 to 3.

2. A slurry according to claim 1, wherein said anionic surfactant is a fatty acid soap.

3. A slurry according to claim 1, wherein said polymer in said modified starch is a partially hydrolyzed polyacrylonitrile.

4. A slurry according to claim 3, wherein at least about 25% of the acrylonitrile groups are hydrolyzed and are present as their sodium salt.

5. A substantially water free high solid content stable and combustible fuel slurry comprising:

a coal-heavy oil mixture, having from about 20 to 40 weight percent of particulate coal of which at least about 80 weight percent passes through a 200 U.S. mesh sieve and from about 60 to 80 weight percent of a heavy oil having a viscosity in the range of about 50 to 300 seconds Saybolt Universal at 175° F, up to 5 weight percent of water based on said mixture, from about 0.05 to 0.25 weight percent based on said mixture of a fatty acid surfactant, and from about 0.05 to 0.015 weight percent based on said mixture of a polymer grafted starch wherein the weight ratio of polymer to starch is in the range of about 0.3 to 3 and said polymer is a partially hydrolyzed polyacrylonitrile.

6. A slurry according to claim 5, when from about 25 to 75 monomer percent of said polymer is hydrolyzed and said polymer is present as the sodium salt.

7. A slurry according to claim 6, wherein said oil is bunker C residual fuel oil.

8. A composition useful for forming a slurry according to claim 1, comprising in combination an anionic surfactant and a polyacrylonitrile grafted starch, wherein the ratio of polyacrylonitrile to starch is in the range of about 0.3 to 3, and wherein at least 25% of the acrylonitrile groups are hydrolyzed to the sodium carboxylic acid salt, the weight ratio of said surfactant to said grafted starch being in the range of about 5-15:1.

9. A composition according to claim 8, wherein said anionic surfactant is a fatty acid soap.

10. A composition according to claim 9, wherein the weight ratio of polyacrylonitrile to starch is in the range of about 0.75 to 2:1.

* * * * *